United States Patent [19]

Kujawa et al.

[11] Patent Number: 4,638,944

[45] Date of Patent: Jan. 27, 1987

[54] COMPACT HIGH VOLUME POINT OF USE INSTANTANEOUS WATER HEATING SYSTEM

[76] Inventors: Stephen M. Kujawa, 90472 Sheffler Rd., Elmira, Oreg. 97437; Melvin H. Simon, Box 529, Cottage Grove, Oreg. 97424

[21] Appl. No.: 853,858

[22] Filed: Apr. 21, 1986

[51] Int. Cl.[4] ..... F24D 3/00

[52] U.S. Cl. ..... 237/8 R; 122/448 B; 126/350 R; 126/351; 236/20 R; 237/19

[58] Field of Search ..... 126/350 R, 351, 362; 236/20 R, 22; 237/8 R, 8 A, 19, 8 D; 122/13 R, 448 B

[56] References Cited

U.S. PATENT DOCUMENTS

| | | | |
|---|---|---|---|
| 1,908,041 | 5/1933 | Miller | 236/20 |
| 2,303,382 | 12/1942 | Newhouse | 236/20 |
| 3,351,128 | 11/1967 | Barnd | 237/8 R |
| 3,461,854 | 8/1969 | Toni et al. | 126/351 |
| 4,037,779 | 7/1977 | Roy et al. | 237/8 R |
| 4,564,003 | 1/1986 | Iwanicki | 126/351 X |

*Primary Examiner*—Edward G. Favors

*Attorney, Agent, or Firm*—Chernoff, Vilhauer, McClung & Stenzel

[57] ABSTRACT

A point of use, instantaneous, high-volume water heating system includes a compact accumulator tank fed by one or more instantaneous gas-fired auxiliary water heaters operating asynchronously to provide a supply of hot water on demand heated to a predetermined temperature. The accumulator tank includes a baffle which separates water in the tank into two temperature zones. A thermostat within the accumulator controls a pump which feeds water from a conventional water heater to the auxiliary water heaters, or alternatively recycles tank water to the auxiliary heaters, when the temperature in the accumulator tank drops below a predetermined minimum.

10 Claims, 1 Drawing Figure

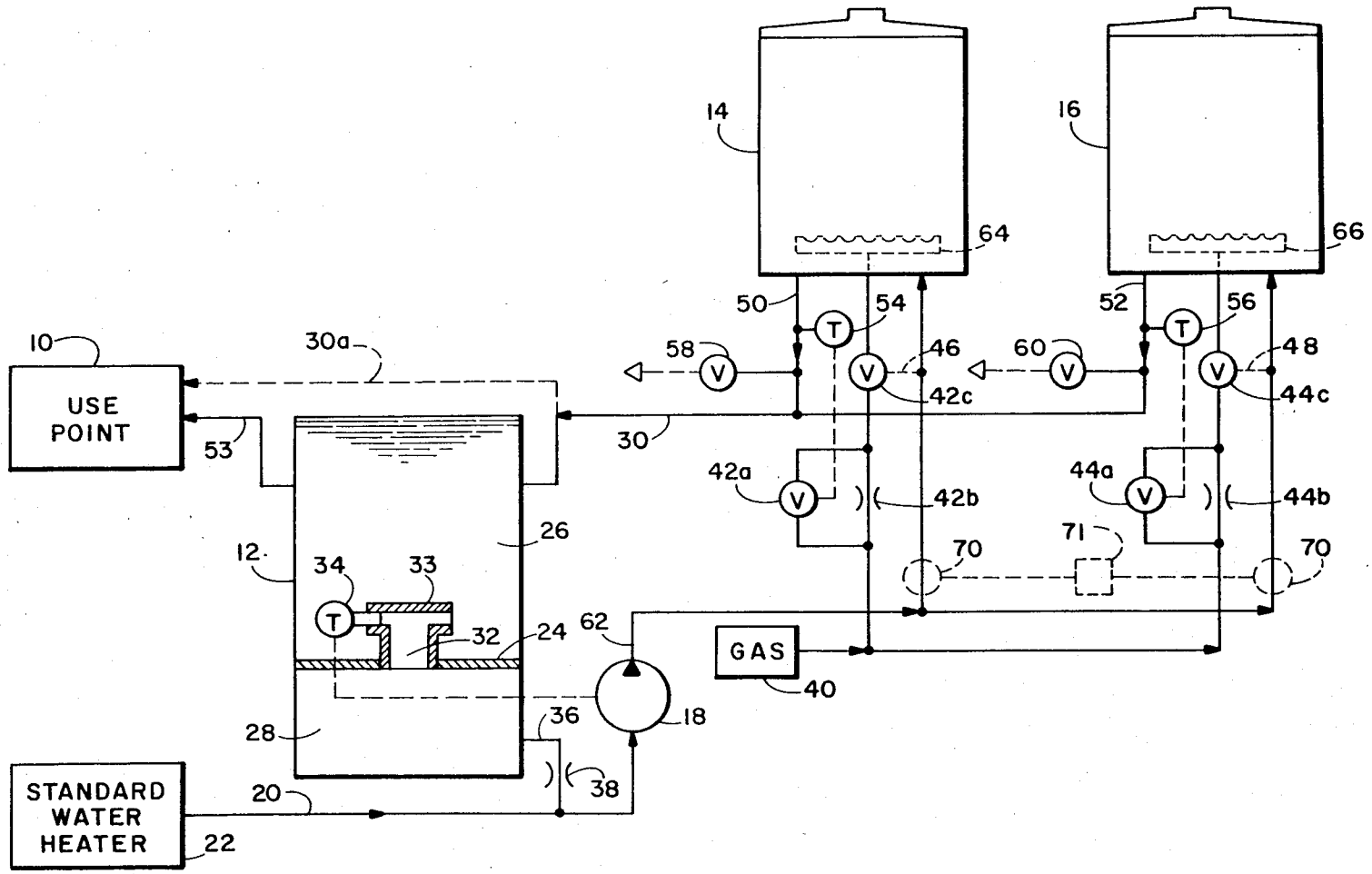
USE POINT
STANDARD WATER HEATER
GAS

COMPACT HIGH VOLUME POINT OF USE INSTANTANEOUS WATER HEATING SYSTEM

BACKGROUND OF THE INVENTION

The following invention relates to a point of use instantaneous water heating system for boosting the temperature of a conventional hot water supply to a temperature necessary for high volume, high temperature use such as commercial dishwashing.

Instantaneous water heating systems are needed for many applications including, for example, dishwashing in commercial food establishments. Since a conventional water heating system is designed for the purpose of supplying water at temperatures of only about 140° F. to an entire facility, it has at times been necessary to install auxiliary water heaters for those applications which require water that is much hotter. Food service establishments, in order to meet local health regulations, must sometimes have dishwashing facilities capable of washing dishes in water that has been heated to approximately 180° to 190° F. This requires the use of such an auxiliary system, which is usually installed downstream from the conventional water heater in order to boost the temperature of the water from the conventional water heater to the desired level.

In order to provide sufficient water on demand, heated to the necessary temperature for these specialized processes, it has been necessary in the past to do one or a combination of the following:

(1) heat all water used in the facility to this higher temperature; or (2) provide a complicated and unreliable valving system to separate the temperature ranges used for each process; or (3) provide a separate, large-tank, gas-fired heating system for the higher temperature usage; or (4) provide a separate, large-tank, electrically-powered heating system for the higher temperature usage (this option, while convenient, has historically resulted in very expensive operating costs and high maintenance costs).

Demand at the use point varies with time. In those high-temperature systems employing an accumulator tank, if the tank were simply to store the heated water when there is no demand at the use point, temperatures in the accumulator tank would decrease with time because of heat loss from the tank. Accordingly, the conventional practice is to replace the lost heat by intermittent reheating. This is conventionally achieved by recirculating the water from the accumulator tank through a high-energy instantaneous heater, preferably of the gas-fired type. If a small accumulator tank is used, water in the recirculation loop can become superheated, possibly causing an explosion in the instantaneous heater or accumulator. Thus, in the past, accumulator tanks for high-temperature systems have been made very large in order to accommodate a relatively large volume of water whose temperature remains more stable during recirculation than would the temperature of water stored in a smaller accumulator tank with less volume capacity.

The problem with the approach described above is that many establishments do not have the space for a large volume accumulator tank in the vicinity of the use point. Moreover, the operating costs of such large-tank systems are quite high.

Another problem with such prior systems is excessive fluctuation in the temperature of water supplied during periods of demand. The high-efficiency instantaneous auxiliary heater is conventionally operated according to a fluctuating duty cycle in response to output temperature to prevent overheating of the water. However, unless the heated water is passed through a large accumulator on its way to the use point, the non-correspondence of the usage load and the fluctuating duty cycle of the heater causes corresponding fluctuations in water temperatures and pressures at the use point. Since the 180° to 190° F. and 50 to 150 psi operating conditions of these systems is very close to the boiling point of water, often these conditions cause the release of high temperature and pressure water and/or steam through the required temperature and pressure relief safety equipment.

What is needed, therefore, is a point of use instantaneous water heating system that is compact and safe and provides hot water on demand at a predetermined, relatively constant temperature.

SUMMARY OF THE INVENTION

The invention of the present system provides the aforementioned capabilities while avoiding the need for a large capacity accumulator tank. Heater water from the outlet of a standard water heater is conducted by means of a pump or pumps to the inlets of one or more auxiliary instantaneous water heaters. The heater(s) and pump(s) are also connected so that the pump will recirculate water through the accumulator during periods of no demand, and deliver instantaneously heated water directly from the heaters to the use point during periods of demand.

The accumulator tank includes a baffle for creating temperature stratification of the water held therein, so that water recirculated back to the heaters is drawn from a zone of relatively low temperature. The baffle may be an interior wall which divides the accumulator tank into two portions and has an aperture for allowing fluid communication from one portion to another. A thermostat is placed adjacent the aperture to control the actuation of the pump. Water recirculated from the tank back to the heater(s) communicates with water from the outlet of the standard water heater, a restriction or comparable valving arrangement optionally being provided to give water from the standard water heater priority of flow over water from the accumulator tank. These features cooperate to insure that water recycled from the accumulator back to the auxiliary water heater(s) does not become super heated.

For installations having multiple instantaneous water heaters, the heaters are preferably caused to operate with asynchronous duty cycles by any of a variety of alternative means. This provides the accumulator tank and use point with a flow of hot water at a relatively constant temperature without the undesirable variations in temperature usually experienced when using a single instantaneous heater that cycles on and off.

It is therefore a principal object of this invention to provide a compact, point of use, instantaneous water heating system capable of delivering large volumes of water heated to a predetermined and consistent temperature to a use point immediately on demand.

A further object of this invention is to provide such an instantaneous, point of use water heating system utilizing a relatively small accumulator tank adjacent the use point.

Yet a further object of this invention is to provide a point of use instantaneous water heating system having multiple auxiliary water heaters operating asynchronously with respect to their duty cycles so as to maintain the temperature of the water supplied to the use point at a relatively constant level during periods of high demand.

A still further object of this invention is to provide a point of use instantaneous water heating system capable of safely circulating hot water from a small accumulator tank through a high-energy, instantaneous heater system without risking super heating of the water and resultant dangerous release of extremely high temperature and high pressure water or steam through the pressure and temperature relief safety equipment.

The foregoing and other objectives, features and advantages of the present invention will be more readily understood upon consideration of the following detailed description of the invention taken in conjunction with the accompanying drawings.

BRIEF DESCRIPTION OF THE DRAWINGS

The single FIGURE is a schematic diagram of an exemplary point of use instantaneous water heating system constructed according to the present invention.

DETAILED DESCRIPTION OF THE INVENTION

The water heating system of the present invention provides hot water to a use point 10 from a relatively small accumulator tank 12. The accumulator tank 12 is fed by a pair of auxiliary, high-energy instantaneous water heaters 14 and 16, respectively, although for low-demand uses a single heater would be sufficient. Water is provided to the auxiliary water heaters 14 and 16 by one or more pressure boosting pumps such as 18, connected to a water input line 20 leading from a standard hot water heater 22 which is a source of water for the system. Water is also recirculated from the accumulator 12 through line 36 and pump 18 to the heaters.

The accumulator tank 12 includes an interior baffle 24 which is a wall or partition separating a top portion 26 of the accumulator tank 12 from a bottom portion 28. The baffle 24 will create temperature stratification of the water held within the accumulator tank 12. In general, the hotter water which is fed to the accumulator tank from heaters 14 and 16 through line 30 will be concentrated in the top portion of the tank 26, whereas the bottom portion of the tank 28 will be a zone of relatively low temperature (although it will normally be hotter than water from the standard water heater 22). This would normally be the case even without the baffle 24 since the hotter water tends to rise to the top; however, the baffle 24 increases the degree of stratification of the water temperature, creating two distinct zones instead of a gradual temperature gradient and reducing thermosyphon currents which tend to equalize tank temperatures. The baffle 24 has an aperture 32 which allows fluid communication through a tee fitting 33 between the top portion 26 and the bottom portion 28. Disposed close to the aperture 32 is a thermostat 34. Thermostat 34, which may be either above or below the baffle 24, controls the operation of pump 18. The accumulator tank recirculation line 36 leads from the zone of relatively low temperature in the bottom portion 28 of the accumulator to the water input line 20 through an optional restriction 38 or similar valving arrangement.

The heaters 14 and 16 are heated by a source 40 of natural gas, LPG or LNG, which is controlled by respective modulating valve arrangements consisting of a valve **42*a* and a restriction 42*b* for heater 14, and a valve 44*a* and restriction 44*b* for heater 16, as well as by the primary valves 42*c* and 44*c*. The primary valves 42*c* and 44*c* are controlled by water pressure pilot lines 46 and 48 which open the valves and activate the heaters in response to sufficient water flow provided by actuation of the pump 18 in response to a decreased temperature in the accumulator sensed by thermostat 34. The modulating valves 42*a* and 44*a* are controlled by respective temperature sensors 54 and 56 at the outputs 50, 52 of the heaters, and modulate the gas supply by opening in response to output water temperature decreasing below a predetermined limit, and closing in response to output water temperature increasing above a predetermined limit. When the modulating valves 42*a* and 44*a* are off, a reduced flow of gas is permitted through restrictions 42*b* and 44*b*. Thermostat 34 deactivates the pump 18 in response to sufficiently high water temperature sensed at the accumulator, and thus deactivates heaters 14 and 16 by closing primary valves 42*c* and 44*c*. Both heaters also include conventional pressure and temperature-responsive safety relief valves 58 and 60**, respectively.

There are two fundamental modes of operation of the system. In both cases, however, it is important that water at a predetermined temperature be available for instantaneous use at the use point 10. In the first mode of operation, which may be termed the "no-demand" mode, there is little or no demand at the use point 10 and the system must, by recirculation, maintain the temperature of the water in the accumulator tank 12 so as to be ready for instantaneous use. In the second, or "demand," mode of operation there is constant demand at the use point 10, and there is little or no recirculation in the accumulator tank 12.

In either case the thermostat 34 is set to actuate pump 18 at a predetermined minimum temperature lower than the desired temperature of the water to be delivered to the use point 10. This is because of the low position of the thermostat 34 in the tank and the fact that there will always be stratification of the temperature of the water held within the accumulator tank. When the thermostat 34 senses the accumulator water temperature dropping below the predetermined minimum, either due to normal accumulator heat loss or due to demand at the use point while the pump 18 is deactivated (the latter drawing cooler water into the bottom of the accumulator through recirculation conduit 36 while hot water is discharged to the use point from the top of the accumulator), it actuates pump 18. The pump draws water from either recirculation line 36 or input line 20, or a combination of both, depending upon water pressure in the tank 12 (which in turn depends on the presence or absence of demand at the use point). Restriction 38 serves to create priority of flow from the standard water heater 22 over that recirculating from the tank 12. However, during periods of no demand when the pump 18 is activated, the pressure in line 36, even with restriction 38, will be higher than the pressure in line 20, and therefore the pump 18 will draw water from recirculation line 36. On the other hand, in the "demand" mode the pressure in the tank 12 will not normally be enough to override the pressure from the standard water heater 22, and water will be drawn from the standard heater 22 until demand ceases. This priority arrangement, the placement and setting of the thermostat 34, and the baffle 24, all contribute toward insuring that the heaters 14 and 16 always receive the lowest temperature water available so as to minimize the danger of super heating.

When pump 18 is actuated by thermostat 34, water is pumped into line 62. The pressure in line 62 is transmitted by pilot lines 46 and 48, which in turn open primary valves 42*c* and 44*c*. Thereafter gas flow is modulated by valves 42*a* and 44*a* in response to heater output temperature sensors 54 and 56 to maintain the output temperatures from the heaters within the desired range. Water is pumped into heaters 14 and 16 by pump 18 where it is heated substantially instantaneously, and is then supplied through respective heater output lines 50 and 52 to the water input line 30 of accumulator tank 12. In the "no demand" mode, the heated water is stored in the tank 12, replacing cooler water recirculated back to the heaters 14 and 16 through line 36. In contrast, in the "demand" mode, the heated water is immediately transferred to the use point through line 53 due to its proximity to the line 30. (In the demand mode, the water could alternatively be transferred directly through a line such as 30*a*, bypassing the accumulator tank 12 and rendering line 53 unnecessary.)

Heater 16 is located at a farther distance away, in terms of the length of line 62, from standard water heater 22 and tank 12 than is heater 14. The use of two such heaters, whose duty cycles are controlled by output thermostats 54 and 56 at substantially the same settings, having different input line lengths from a common source of heated water, will result in the two heaters having asynchronous duty cycles, i.e. different periods of high-energy heating during which modulating valves 42*a* and 44*a*, respectively, are open. This is due to the fact that water from pump 18 loses more heat while traveling a further distance in a greater amount of time to arrive at heater 16 than it does to arrive at heater 14. Since the water is thus cooler entering heater 16, it takes a longer time for it to be heated to the temperature at which thermostat 56 will cut off the flow of gas through valve 44*a*. Thus, although both heaters 14 and 16 will cycle between the on and off conditions of their respective modulating valves 42*a* and 44*a*, they will do so at different times, making the temperature of hot water flowing in line 30 relatively constant. As a result, the temperature of the water supplied to the use point immediately during periods of demand likewise remains relatively constant and the system does not experience the undesireable hot/cold cycles that can be present if a single larger heater were used, or if multiple heaters having synchronous duty cycles were used.

The use of the dual heaters 14 and 16 operating asynchronously helps to permit the use of a smaller-sized accumulator tank 12 adjacent the use point 10, since no large accumulator volume is required to smooth out water temperature fluctuations. Asynchronous operation may be achieved by other, more accurate, means, including timing circuits set for asynchronous switching of valves 42*a* and 44*a*, or triggering circuits governed by the thermostats 54 and 56, respectively, for switching valve 42*a* on whenever valve 44*a* is off, and vice versa. Alternatively, water supply controls such as valves 70 can be operated asynchronously by a timer such as 71 to cause the supply of water to the respective heaters to be asynchronous, thereby causing the primary valves 42*c* and 44*c* to operate asynchronously. However, the difference in input line length provides a relatively simple, inexpensive structure for accomplishing this purpose.

The system described above utilizes water as the fluid to be used at the use point 10. However, this system may be used for any fluid which may have to be heated and made available for instantaneous use, and is therefore not limited to applications calling for hot water.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A fluid heating system comprising:

(a) a fluid source;

(b) a use point for intermittently demanding fluid from said fluid source;

(c) respective first and second instantaneous heater means interposed operatively between said fluid source and said use point for heating fluid from said fluid source substantially instantaneously and delivering it substantially immediately after heating to said use point during periods of demand, each of said heater means having a respective control means for automatically varying the heating performed by the respective heater means in accordance with a respective duty cycle; and (d) means for causing said control means to operate said first and second heater means at respective duty cycles substantially asynchronous with respect to each other.

2. The fluid heating system of claim 1, including means for providing fluid from said fluid source to said first heater means at a higher temperature than to said second heater means.

3. The fluid heating system of claim 1 wherein said fluid source includes means for preheating said fluid, further including fluid conduit means interconnecting said fluid source with said first and second heater means for conducting fluid from said fluid source to said first and second heater means, said fluid conduit means including means for causing said fluid to lose more heat while being conducted to said second heater means than while being conducted to said first heater means.

4. The fluid heating system of claim 3 wherein said conduit means includes means for causing said fluid to be conducted over a greater distance from said fluid source to said second heater means than to said first heater means.

5. The fluid heating system of claim 1, including means for providing fluid from said fluid source to said first and second heater means asynchronously.

6. The fluid heating system of claim 1, further including an accumulator tank connected to said first and second heater means and to said use point for receiving heated fluid from said first and second heater means and storing said fluid for delivery to said use point.

7. The fluid heating system of claim 6 wherein said accumulator tank includes a recirculation conduit for providing fluid from said accumulator tank to said first and second heater means in addition to fluid from said fluid source.

8. A fluid heating system comprising:

(a) a fluid source;

(b) a use point for intermittently demanding fluid from said fluid source;

(c) instantaneous heater means interposed operatively between said fluid source and said use point for heating fluid from said fluid source substantially instantaneously and delivering it substantially immediately after heating to said use point during periods of demand;

(d) accumulator means connected to said use point and to said heater means for receiving heated fluid from said heater means and storing it for delivery to said use point upon the initiation of a demand, said accumulator means having a recirculation conduit for providing fluid to said heater means, said accumulator means including means for establishing respective fluid zones of relatively higher and lower temperatures within said accumulator means, and said recirculation conduit being connected to said accumulator means so as to provide fluid to said heater means from a zone of relatively lower temperature within said accumulator means; and (e) thermostat means, responsive to the temperature of fluid within said accumulator means, for preventing fluid from being provided to said heater means through said recirculation conduit in response to the temperature of said fluid sensed by said thermostat means being above a predetermined temperature.

9. The fluid heating system of claim 8, including interior baffle means within said accumulator means for inhibiting the flow of fluid between said zone of relatively higher temperature and said zone of relatively lower temperature within said accumulator means.

10. The fluid heating system of claim 8, further including means associated with said recirculation conduit for causing fluid to be supplied to said instantaneous heater means from said fluid source unless the pressure of fluid in said accumulator means is greater than the pressure of fluid from said fluid source.

* * * * *